US010400780B2

(12) United States Patent
Xu et al.

(10) Patent No.: US 10,400,780 B2
(45) Date of Patent: Sep. 3, 2019

(54) STRUCTURE OF FAN BLADES

(71) Applicant: ASIA VITAL COMPONENTS CO., LTD., New Taipei (TW)

(72) Inventors: Liang-Hua Xu, New Taipei (TW); Te-Chung Wang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 372 days.

(21) Appl. No.: 15/064,562

(22) Filed: Mar. 8, 2016

(65) Prior Publication Data

US 2017/0260995 A1 Sep. 14, 2017

(51) Int. Cl.
*F04D 29/28* (2006.01)
*F04D 29/62* (2006.01)

(52) U.S. Cl.
CPC ..... *F04D 29/281* (2013.01); *F04D 29/624* (2013.01)

(58) Field of Classification Search
CPC .... F04D 29/281; F04D 29/624; F04D 29/388; F04D 29/34; F04D 25/08; F04D 19/002
See application file for complete search history.

(56) References Cited

U.S. PATENT DOCUMENTS 3,446,429 A * 5/1969 Ogawa ..... F04D 29/646 416/220 A
4,060,338 A * 11/1977 Macauley ..... F04D 29/34 416/208
4,173,429 A * 11/1979 Hoffman ..... F01D 5/025 416/184
4,205,510 A * 6/1980 Raniero ..... A01D 34/82 56/12.9
4,662,830 A * 5/1987 Pottebaum ..... H05K 7/20172 361/695
4,715,784 A * 12/1987 Mosiewicz ..... F01D 5/3069 29/557
5,487,639 A * 1/1996 Asabuki ..... F04D 23/008 415/55.1
6,139,277 A * 10/2000 Lopatinsky ..... F01D 5/3015 416/220 A
6,619,923 B2 * 9/2003 Chien ..... F04D 29/2222 416/183
7,097,430 B2 * 8/2006 Harris ..... B29C 45/14065 264/45.3
7,399,161 B2 * 7/2008 Kao ..... F04D 29/30 416/187

(Continued)

*Primary Examiner* — Justin D Seabe
*Assistant Examiner* — Adam W Brown
(74) *Attorney, Agent, or Firm* — Jackson IPG PLLC; Demian K. Jackson

(57) ABSTRACT

The present invention relates to an improved structure of fan blades, which comprises a hub, a connecting part, and a plurality of fan blades. The connecting part has a coupling section and a plurality of slits. The connecting part is sleeved around the perimeter of the hub through the coupling section. The slits are circularly disposed close to the perimeter of the connecting part. The fan blades individually have a first end and a second end; the first ends are individually embedded in the slits and combined with the connecting part. Be means of the present invention, the disadvantage of the combination through a non-integrated structure of the fan blades and the hub in the prior art can be overcome.

6 Claims, 9 Drawing Sheets

(56) References Cited

U.S. PATENT DOCUMENTS

| | | | | |
|---|---|---|---|---|
| 8,128,372 | B2 * | 3/2012 | Best | F04D 29/34 416/207 |
| 8,333,438 | B2 * | 12/2012 | Caule | B64C 25/36 188/264 AA |
| 8,727,729 | B2 * | 5/2014 | Noronha | B23P 15/006 416/186 R |
| 8,807,939 | B2 * | 8/2014 | Gardas | F04D 29/646 416/147 |
| 9,267,507 | B2 * | 2/2016 | Wu | F04D 25/0613 |
| 9,523,372 | B2 * | 12/2016 | Stagg | B29C 45/14336 |
| 9,664,194 | B2 * | 5/2017 | Oleson | F04D 25/088 |
| 2009/0297344 | A1 * | 12/2009 | Hill | F01D 5/048 415/208.1 |
| 2013/0243628 | A1 * | 9/2013 | Zheng | F04D 17/04 417/423.7 |
| 2015/0013945 | A1 * | 1/2015 | Choi | F24F 1/0007 165/121 |
| 2015/0233389 | A1 * | 8/2015 | Moll | F04D 29/662 416/145 |
| 2017/0284405 | A1 * | 10/2017 | Eggers | F04D 25/088 |

* cited by examiner

STRUCTURE OF FAN BLADES

BACKGROUND OF THE INVENTION

Field of the Invention

The present invention relates to an improved structure of fan blades and in particular to an improved structure of fan blades, which improves the combination of the fan blades and the hub.

Description of Prior Art

The current fan blades are combined with the hub mainly by wrapping by injection or welding in which the plastic fan blades combined with the metal hub is the most popular case. In such a structure, the metal hub is placed in a mold and then the melted plastic material is filled around the perimeter of the metal hub by the injection molding. When the plastic material is cooled, plural fan blades are formed at the perimeter of the metal hub. However, when the disposition of a structure of ultra-thin fan blades is required, the ultra-thin fan blades lacks structural strength and the fan blades cannot increase pressure to guide the air flow. What's worse is when the fan rotates with overspeed, the fan blades will not operate properly due to eccentric deflection.

Moreover, the skilled person in the art replaces the plastic fan blades with metal fan blades with higher structural strength. The metal fan blades are fabricated independently and then are combined with the metal hub by welding, which can overcome the disadvantage of insufficient structural strength in the plastic fan blades. However, it is difficult to control the balance of the combination of the metal fan blades and the metal hub by welding. Also, the solder used in welding between the metal fan blades and the metal hub is prone to cause unbalanced situations during the rotation.

Therefore, how to maintain proper combination strength between the metal fan blades and the metal hub and an operating stability without eccentric deflection is the focus which the inventor and the related manufacturers in this industry have been devoting themselves to.

SUMMARY OF THE INVENTION

Thus, to effectively overcome the above problems, the primary objective of the present invention is to provide an improved structure of fan blades with higher structural strength and reduced thickness.

To achieve the above objective, the present invention provides an improved structure of fan blades, which comprises a hub, a connecting part, and a plurality of fan blades.

The connecting part has a coupling section and a plurality of slits. The connecting part is sleeved around the perimeter of the hub through the coupling section. The slits are circularly disposed close to the perimeter of the connecting part. The fan blades individually have a first end and a second end. The first ends of the fan blades are individually embedded in the slits and combined with the connecting part.

In the present invention, the fan blades are fixed to the connecting part and then the connecting part is sleeved around the perimeter of the hub. In this way, the disadvantages of the easy eccentric deflection and difficult control caused by the combination of the traditional fan blades and the hub by welding can be overcome and also an easy combination structure is provided.

DETAILED DESCRIPTION OF THE INVENTION

The above objective, structural and functional characteristics of the present invention will be described according to the preferred embodiments with the accompanying figures.

Figure 1:
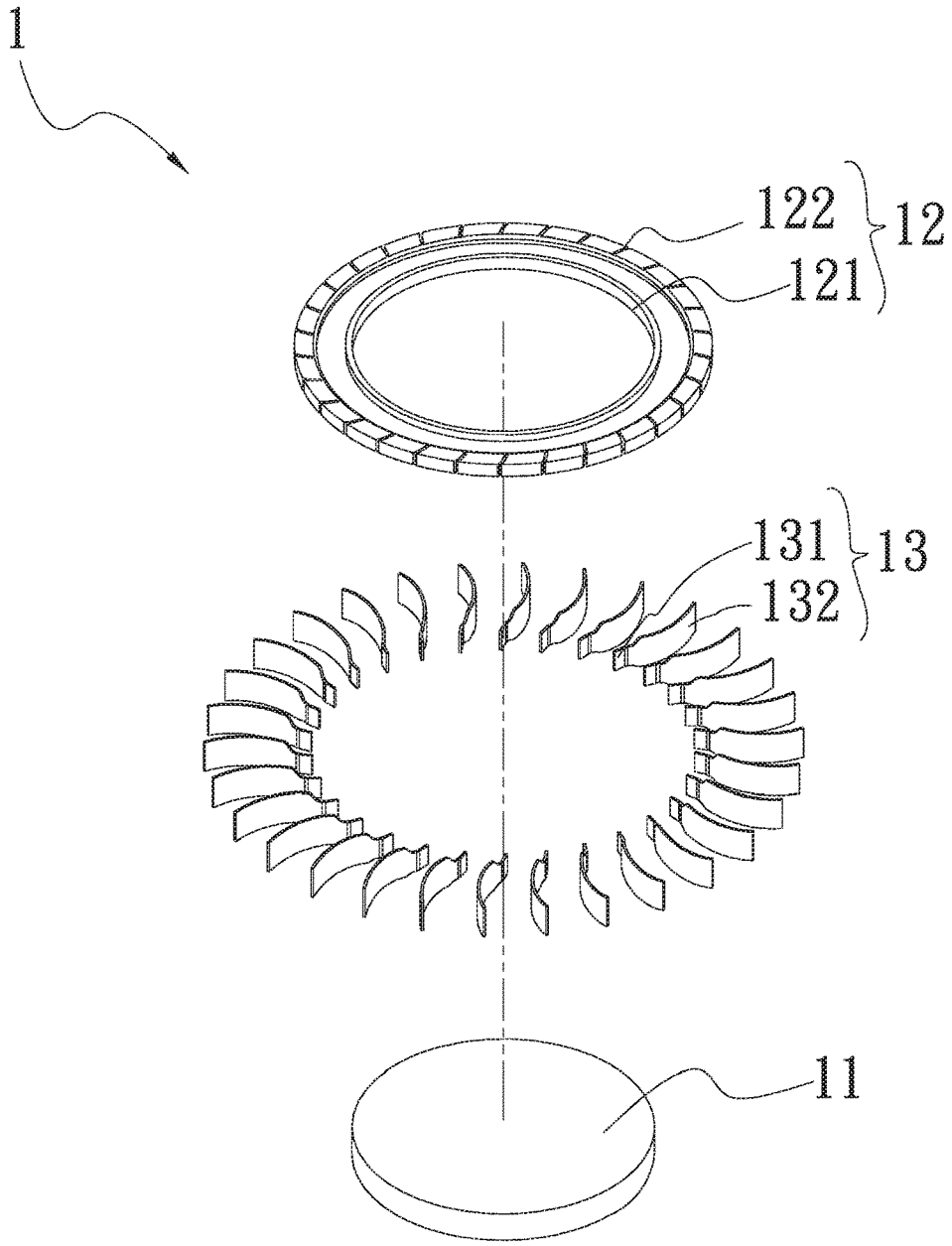
FIG. 1 is a perspective exploded view of the improved structure of fan blades according to the first embodiment of the present invention.
Figure 2:
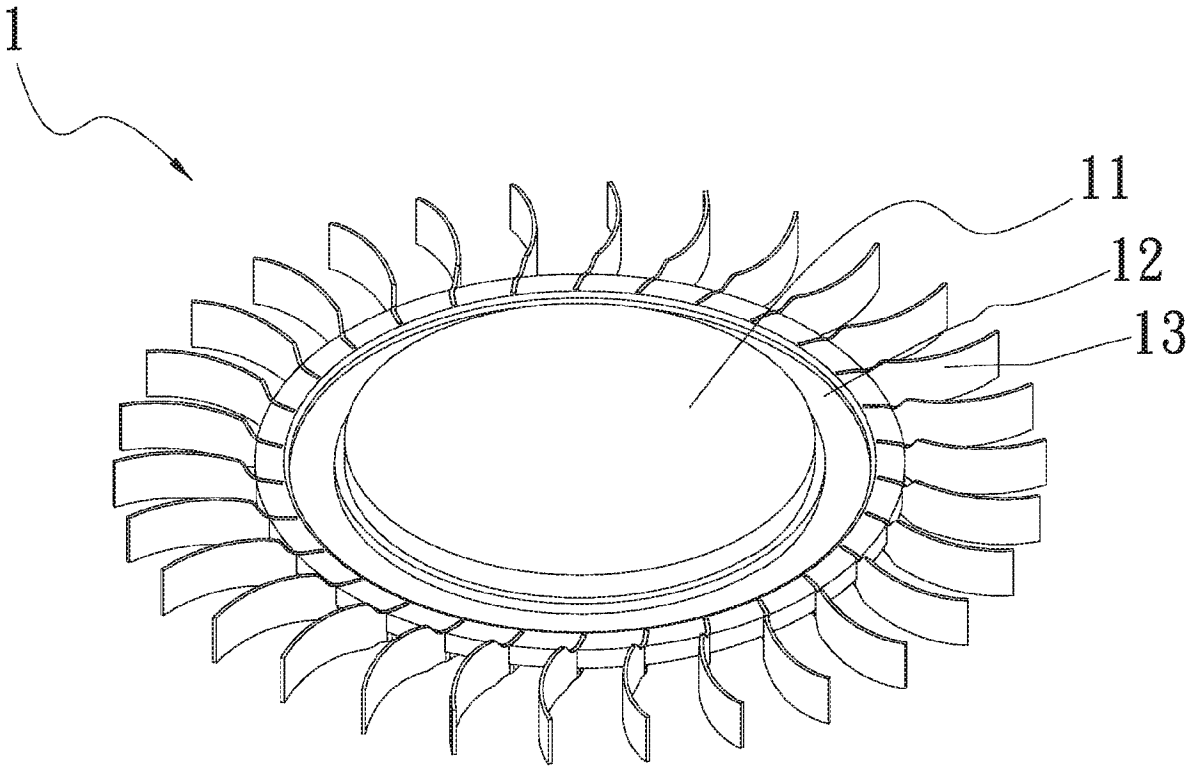
FIG. 2 is a perspective assembled view of the improved structure of fan blades according to the first embodiment of the present invention.
Figure 2A:
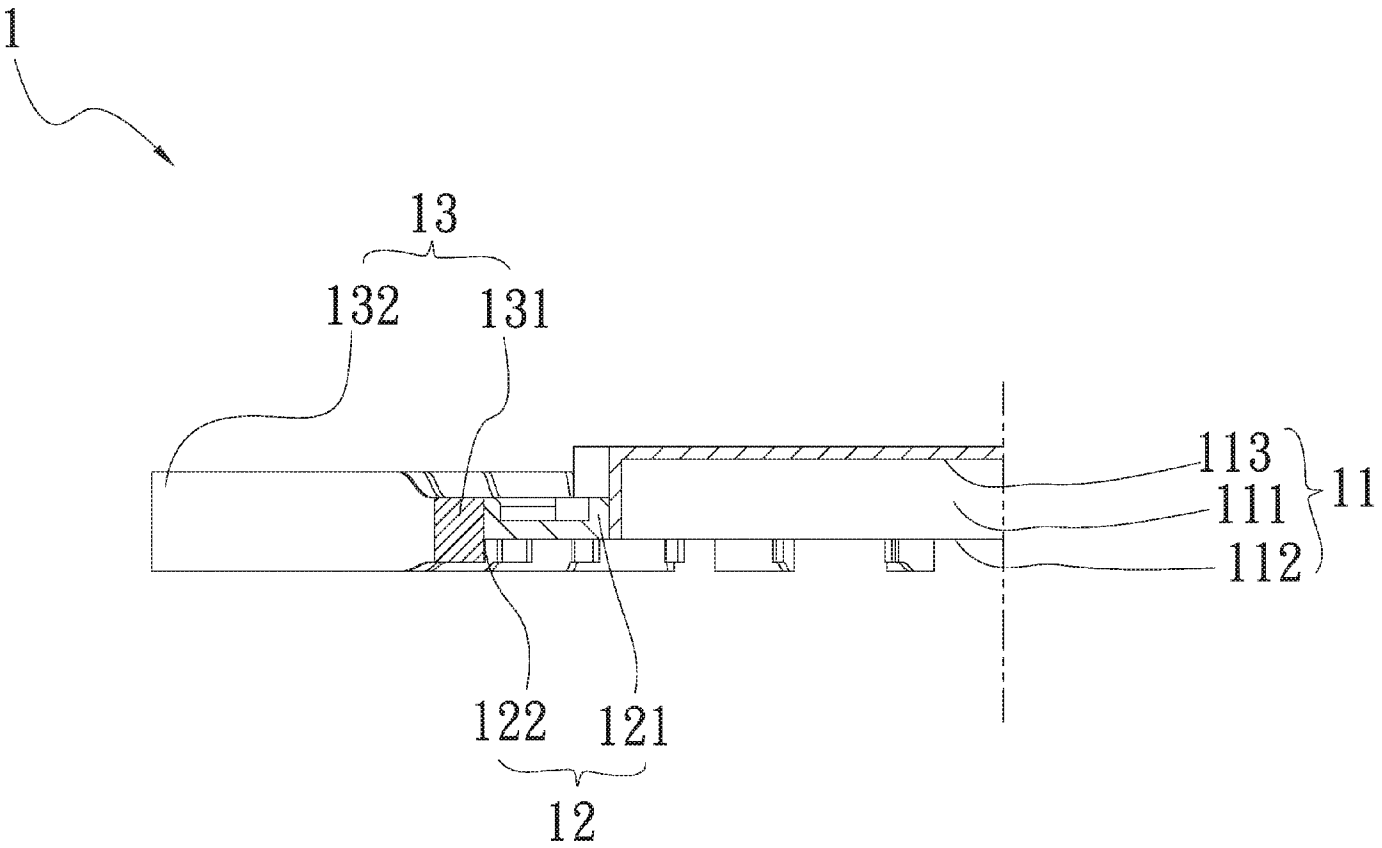
FIG. 2A is a cross-sectional assembled view of the improved structure of fan blades according to the first embodiment of the present invention.

Please refer to FIGS. 1, 2, and 2A, which are the perspective exploded view, the perspective assembled view, and the cross-sectional assembled view of the improved structure of fan blades according to the first embodiment of the present invention, respectively. As shown in FIGS. 1, 2, and 2A, the improved structure of fan blades 1 comprises a hub 11, a connecting part 12, and a plurality of fan blades 13.

The hub 11 is a hollow shell having a circular shape. The hub 11 has a receiving space 111, an open side 112, and a closed side 113. The open side 112 and the closed side 113 communicate with the receiving space 111.

The connecting part 12 has a coupling section 121 and a plurality of slits 122. The connecting part 12 is sleeved around the perimeter of the hub 11 through the coupling section 121. The slits 122 are circularly disposed close to the perimeter of the connecting part 12. The slits 122 are spaced evenly or unevenly. In the current embodiment, the slits 122 being spaced evenly is used as an example for explanation, but not limited to this.

The coupling section 121 is a through hole communicating with the top side and the bottom side of the connecting part 12. That is, the connecting part is an annulus structure. The connecting part 12 and the hub 11 can be combined and fixed to each other by tight fitting or welding.

Each of the fan blades 13 has a first end 131 and a second end 132 which are individually disposed at two ends of the each of fan blades 13. The first ends 131 of the fan blades 13 are individually embedded in the corresponding slits 122 of the connecting part 12 and thus are combined with the connecting part 12.

The connecting part 12 can be made of plastic or metal. If the connecting part 12 is made of metal, the first ends 131 of the fan blades 13 are embedded in the slits 122 by tight fitting or the first ends 131 of the fan blades 13 are melted to the slits 122 of the connecting part 12 by laser welding or the first ends 131 of the fan blades 13 are combined with the connecting part 12 by riveting.

Furthermore, the fan blades 13 can be also placed in a mold (not shown). Then, the structure of the connecting part 12 is formed by injection molding to combine the fan blades 13 and the connecting part 12.

The height of the first end 131 of the fan blade 13 can be selected to be smaller than or equal to that of the second end 132. In the current embodiment, the height of the first end 131 smaller than that of the second end 132 is used as an example, but not limited to this.

The fan blades 13 have a curved shape or a non-curved shape. In the current embodiment, the fan blades 13 having a curved shape is used as an example, but not limited to this.

Figure 3:
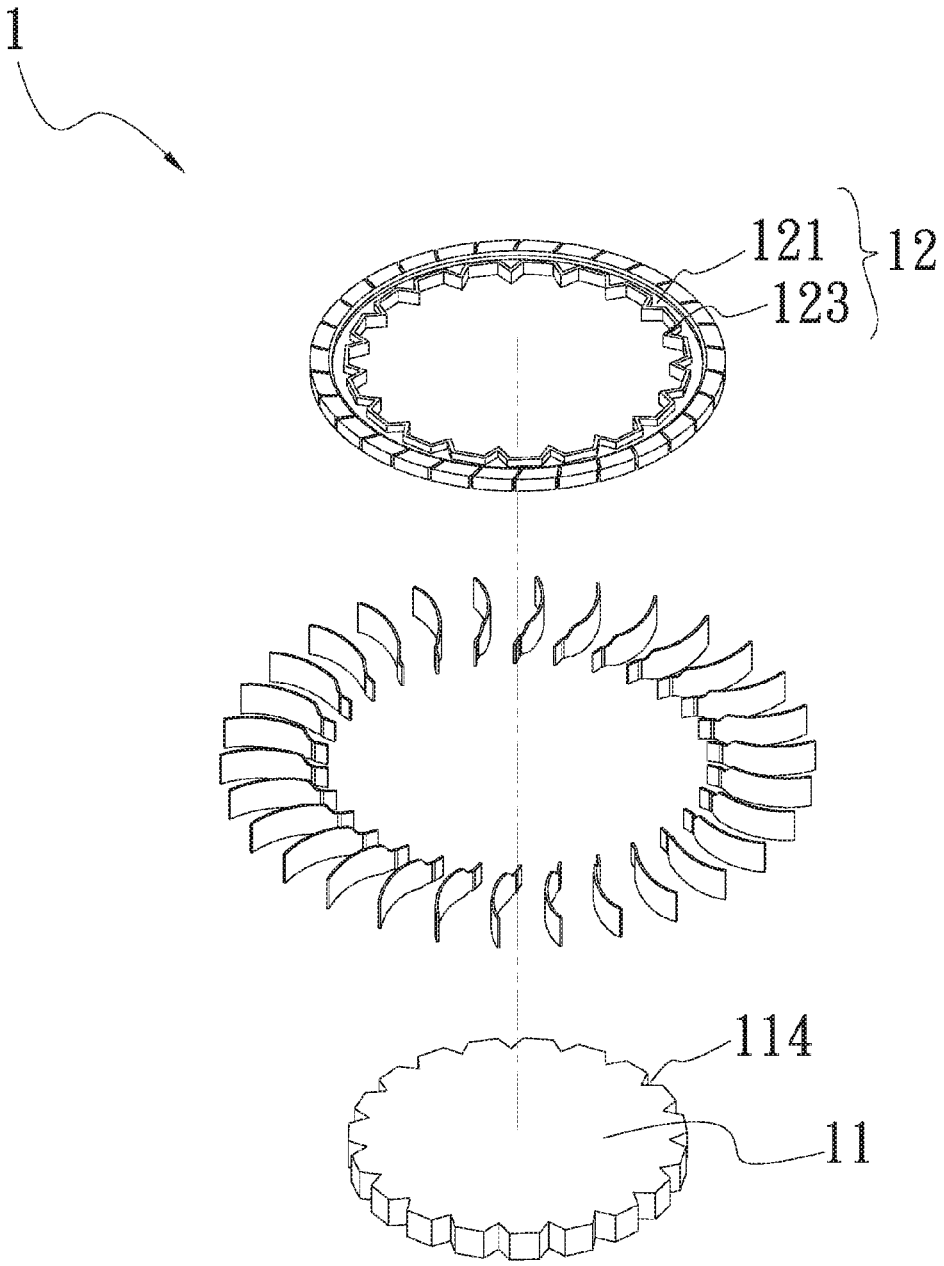
FIG. 3 is a perspective exploded view of the improved structure of fan blades according to the second embodiment of the present invention.
Figure 4:
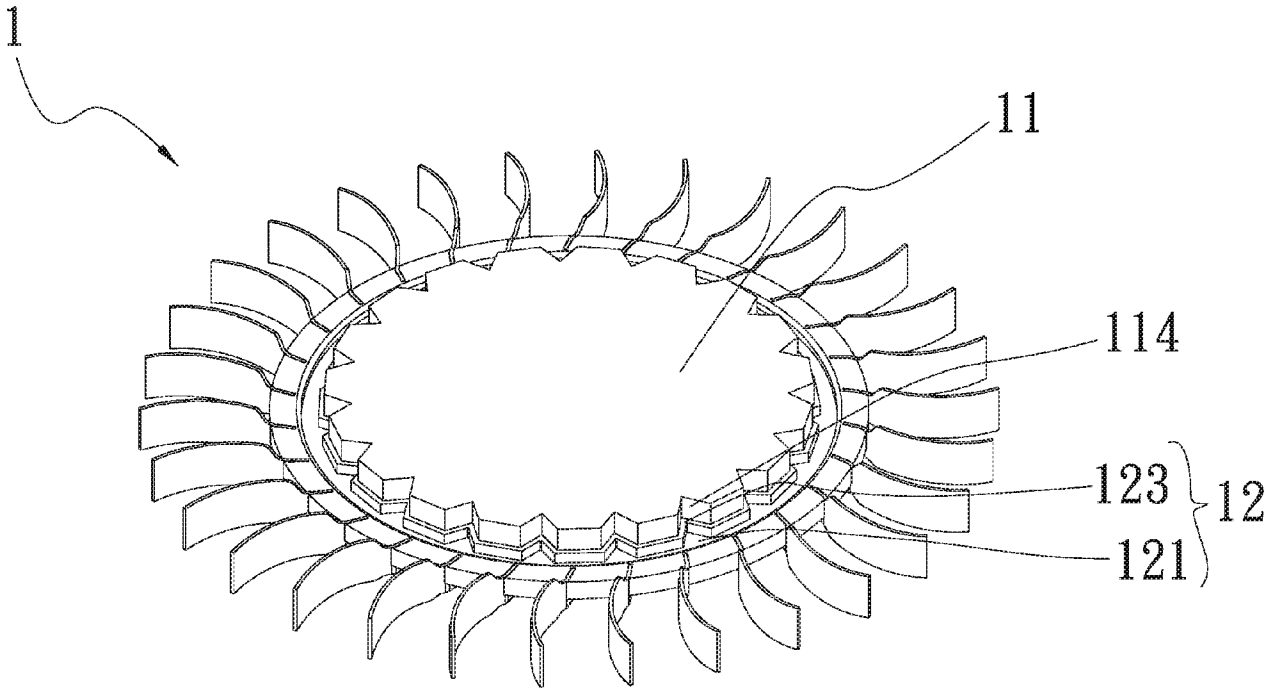
FIG. 4 is a perspective assembled view of the improved structure of fan blades according to the second embodiment of the present invention.

Please refer to FIGS. 3 and 4, which are the perspective exploded view and the perspective assembled view of the improved structure of fan blades according to the second embodiment of the present invention, respectively. As shown in FIGS. 3 and 4, the structures in the current embodiment identical to those in the first embodiment will not be described here again. The difference is that in the second embodiment, the hub 11 further comprises a plurality of notches 114 which are circularly disposed at the perimeter of the hub 11. A plurality of raised parts 123 are disposed on the coupling section 121 of the connecting part 12 corresponding to the notches 114 and the raised parts 123 are embedded in the notches 114 correspondingly. By means of such a structure, the combination strength between the hub 11 and the connecting part 12 can be increased and the loosening of the connecting part 12 from the hub 11 can be avoided.

The notches 114 have a square, triangular, semicircular, or trapezoidal shape. The raised parts 123 have a shape matching with the notches 114 such that a combination of concavity and convexity is obtained. In the current embodiment, the notches 114 having a triangular shape is used as an example, but not limited to this.

Figure 5:
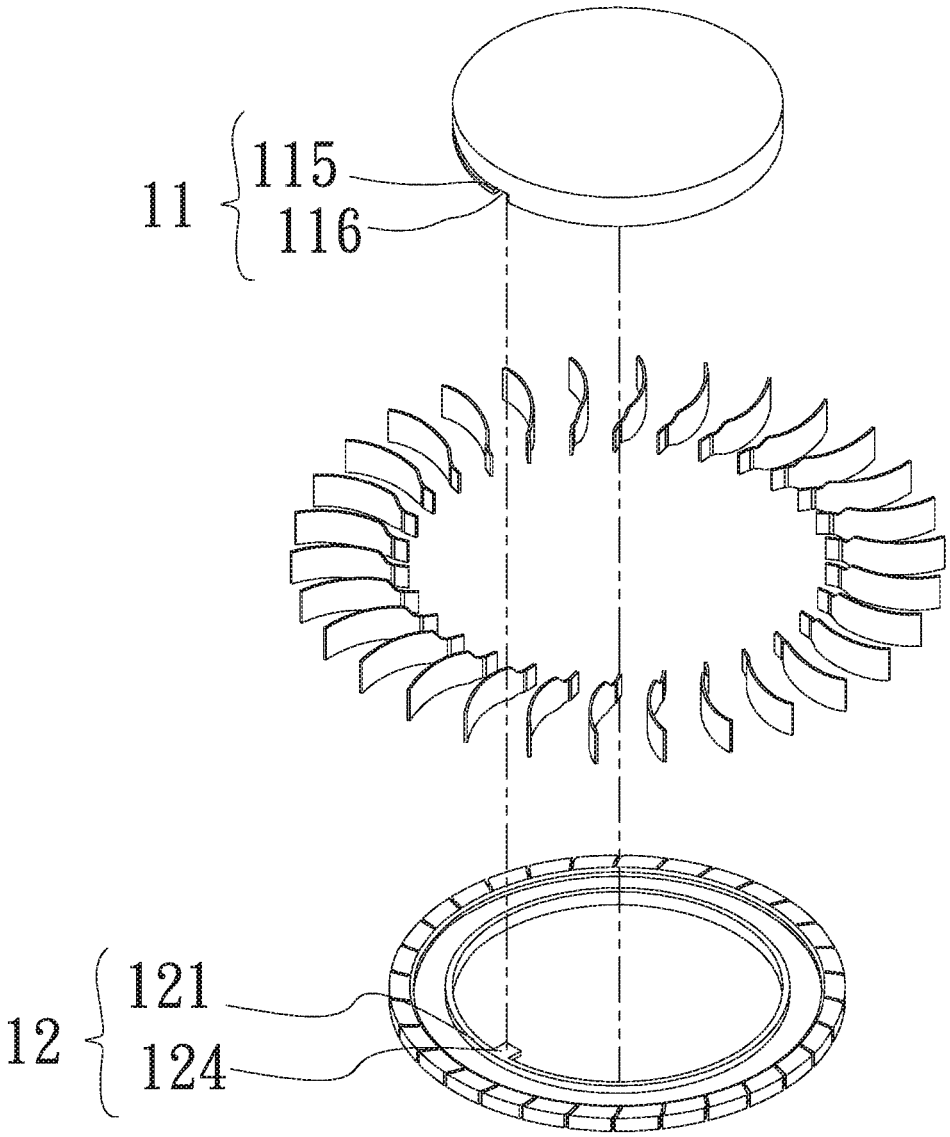
FIG. 5 is a perspective exploded view of the improved structure of fan blades according to the third embodiment of the present invention.
Figure 6:
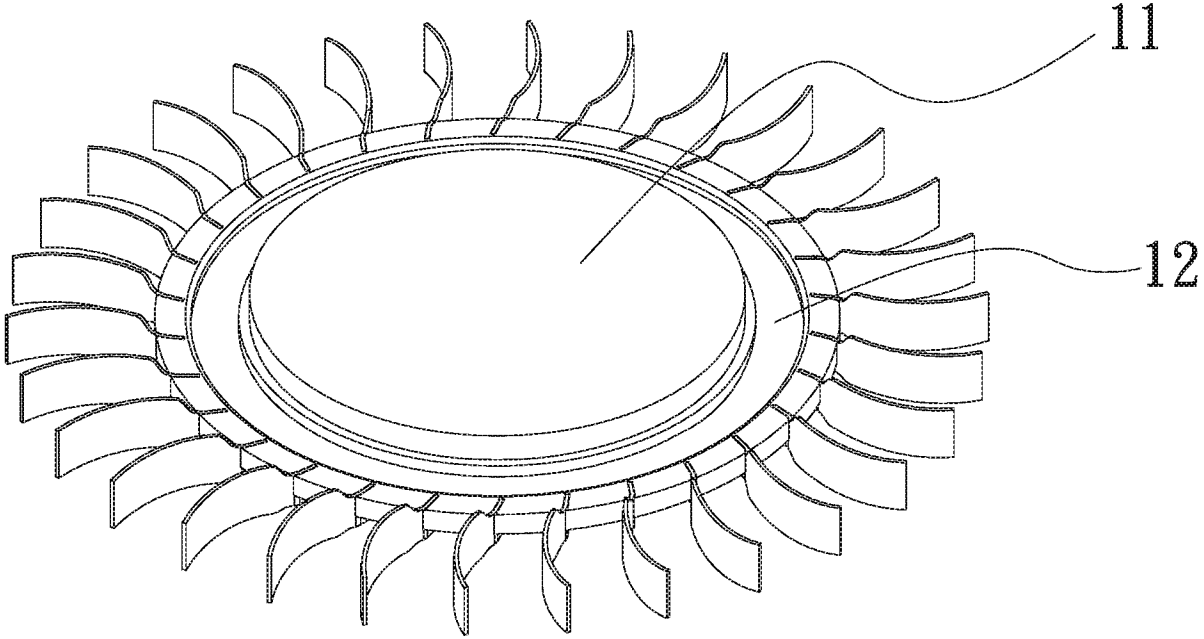
FIG. 6 is a perspective assembled view of the improved structure of fan blades according to the third embodiment of the present invention.

Please refer to FIGS. 5 and 6, which are the perspective exploded view and the perspective assembled view of the improved structure of fan blades according to the third embodiment of the present invention, respectively. As shown in FIGS. 5 and 6, the structures in the current embodiment identical to those in the first embodiment will not be described here again. The difference is that in the third embodiment, the hub 11 further comprises at least one groove 115 disposed circularly at the perimeter of the hub 11. At least one pin 124 is disposed on the coupling section 121 of the connecting part 12 corresponding to the groove 115. The pin 124 is embedded in the groove 115 correspondingly. A slot 116 is disposed at one end of the groove 115. When the connecting part 12 rotates clockwise or counterclockwise with respect to the hub 11, the pin 124 will slide in the groove 115 correspondingly. When the pin 124 slides into the slot 116 correspondingly, the latch between the connecting part 12 and the hub 11 is achieved. On the contrary, when the pin 124 moves out of the slot 116, the latch between the connecting part 12 and the hub 11 is released.

Figure 7:
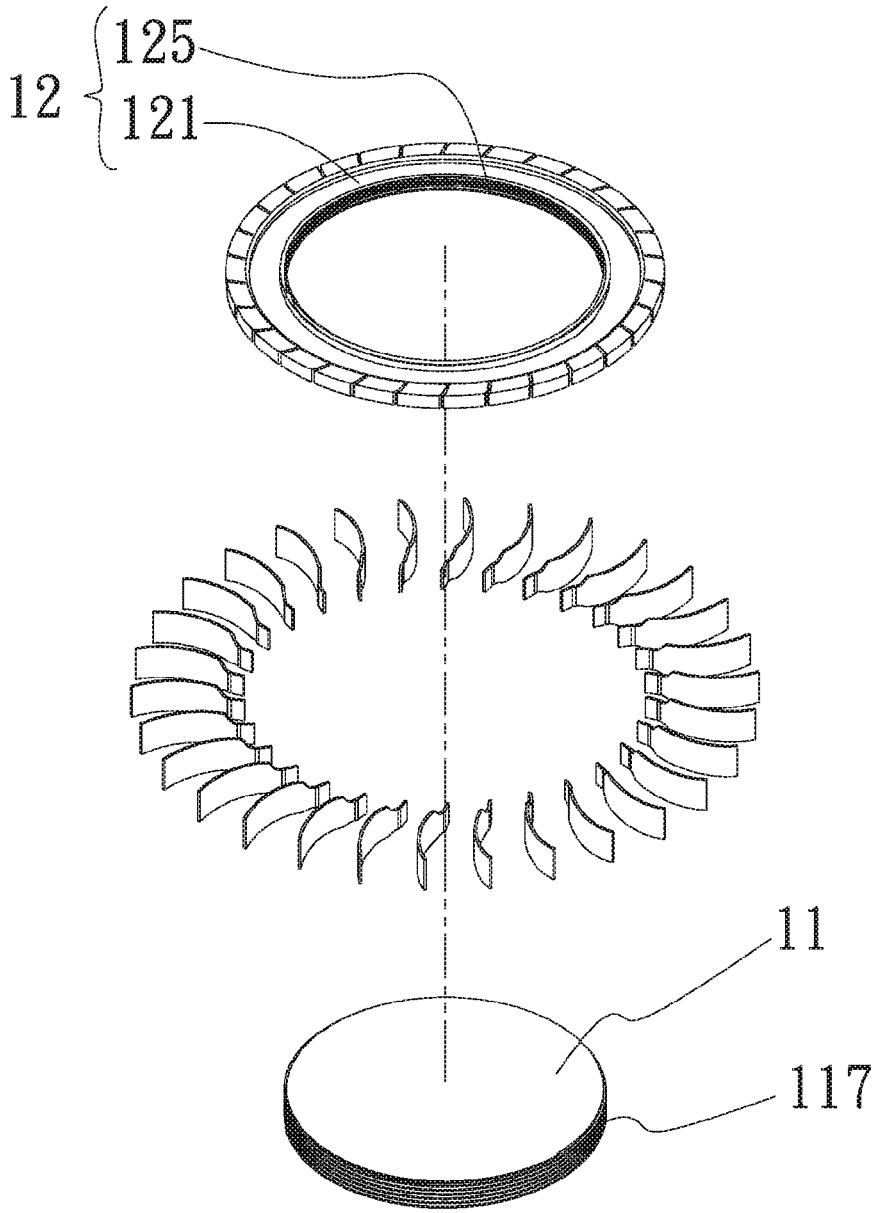
FIG. 7 is a perspective exploded view of the improved structure of fan blades according to the fourth embodiment of the present invention.
Figure 8:
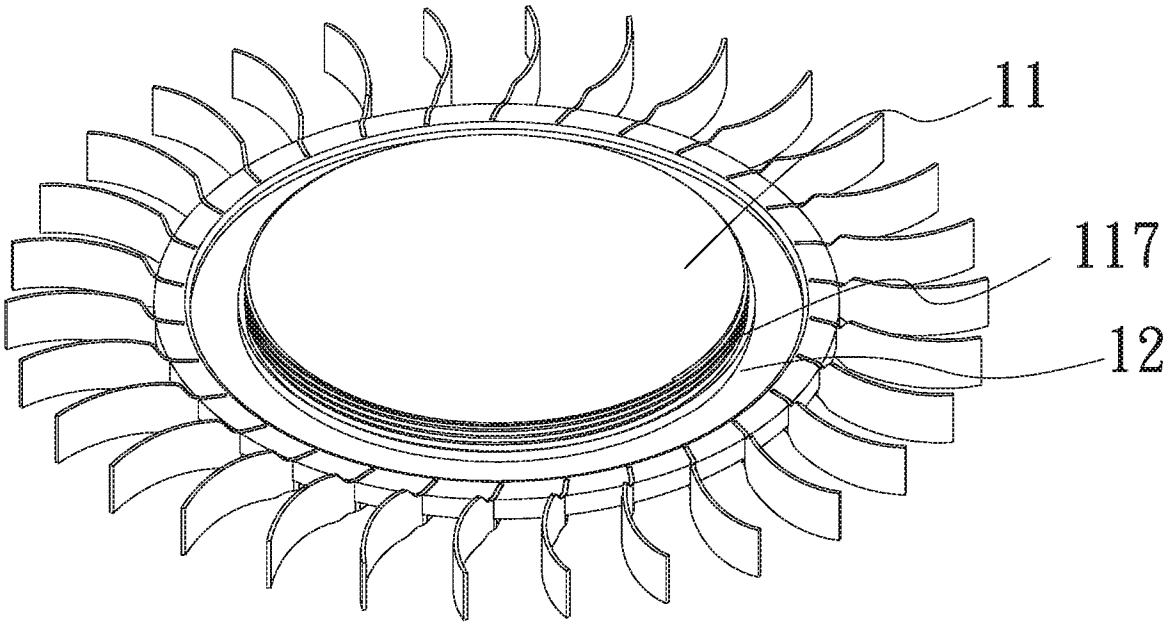
FIG. 8 is a perspective assembled view of the improved structure of fan blades according to the fourth embodiment of the present invention.

Please refer to FIGS. 7 and 8, which are the perspective exploded view and the perspective assembled view of the improved structure of fan blades according to the fourth embodiment of the present invention, respectively. As shown in FIGS. 7 and 8, the structures in the current embodiment identical to those in the first embodiment will not be described here again. The difference is that in the fourth embodiment, the hub 11 further comprises an external thread 117 disposed circularly at the perimeter of the hub 11. An internal thread 125 is disposed on the coupling section 121 of the connecting part 12 corresponding to the external thread 117. The internal and external threads 125, 117 perform assembly or disassembly by clockwise or counterclockwise turn.

In the above-mentioned embodiments (i.e., the first, second, third, and fourth embodiments), the hub 11, the fan blades 13, and the connecting part 12 can be of the same or different materials, which can be formed by a punching process.

Also, the combination of the fan blades 13 and the connecting part 12 can be performed by fast punching to force the fan blades 13 into the slits 122 of the connecting part 12, which can increase the assembly rate and further the combination degree of the fan blades 13 and the connecting part 12.

What is claimed is:

1. An improved structure of fan blades, comprising:

a hub having a receiving section disposed at an outer perimeter of the hub;

a connecting part having a coupling section and a plurality of slits, wherein the connecting part is sleeved directly onto and connected with the outer perimeter of the hub via direct engagement of the coupling section with the receiving section of the hub and wherein the slits are circularly disposed at an outer perimeter of the connecting part; and a plurality of fan blades individually having a first end and a second end, wherein the first ends of the fan blades are individually embedded in the slits and combined with the connecting part, wherein the receiving section defines a plurality of notches which are circularly disposed at the outer perimeter of the hub and wherein the coupling section defines a plurality of raised parts embedded in the notches correspondingly.

2. The improved structure of fan blades according to claim 1, wherein a height of the first end is smaller than or equal to a height of the second end.

3. The improved structure of fan blades according to claim 1, wherein the notches have a square, triangular, semicircular, or trapezoidal shape and wherein the raised parts have a shape matching with the notches such that a combination of concavity and convexity is obtained.

4. The improved structure of fan blades according to claim 1, wherein the fan blades have a curved shape or a non-curved shape.

5. An improved structure of fan blades, comprising:

a hub having a receiving section disposed at an outer perimeter of the hub;

a connecting part having a coupling section and a plurality of slits, wherein the connecting part is sleeved directly onto and connected with the outer perimeter of the hub via direct engagement of the coupling section with the receiving section of the hub and wherein the slits are circularly disposed at an outer perimeter of the connecting part; and a plurality of fan blades individually having a first end and a second end, wherein the first ends of the fan blades are individually embedded in the slits and combined with the connecting part, wherein the receiving section defines a groove disposed circularly at the outer perimeter of the hub and wherein the coupling section defines at least one pin embedded in the groove correspondingly.

6. An improved structure of fan blades, comprising:

a hub having a receiving section disposed at an outer perimeter of the hub;

a connecting part having a coupling section and a plurality of slits, wherein the connecting part is sleeved directly onto and connected with the outer perimeter of the hub via direct engagement of the coupling section with the receiving section of the hub and wherein the slits are circularly disposed at an outer perimeter of the connecting part; and a plurality of fan blades individually having a first end and a second end, wherein the first ends of the fan blades are individually embedded in the slits and combined with the connecting part, wherein the receiving section defines an external thread disposed circularly at the outer perimeter of the hub, the coupling section defines an internal thread, and the internal and external threads perform assembly or disassembly by clockwise or counterclockwise rotation therebetween.

* * * * *